US008177149B2

(12) United States Patent
Nied

(10) Patent No.: US 8,177,149 B2
(45) Date of Patent: May 15, 2012

(54) METHOD FOR THE PRODUCTION OF VERY FINE PARTICLES BY MEANS OF A JET MILL

(76) Inventor: Roland Nied, Bonstetten (DE)

( * ) Notice: Subject to any disclaimer, the term of this patent is extended or adjusted under 35 U.S.C. 154(b) by 507 days.

(21) Appl. No.: 12/296,761

(22) PCT Filed: Apr. 13, 2007

(86) PCT No.: PCT/DE2007/000649

§ 371 (c)(1),
(2), (4) Date: Jul. 21, 2009

(87) PCT Pub. No.: WO2007/118460

PCT Pub. Date: Oct. 25, 2007

(65) Prior Publication Data

US 2010/0065668 A1 Mar. 18, 2010

(30) Foreign Application Priority Data

Apr. 13, 2006 (DE) ..... 10 2006 017 472

(51) Int. Cl.
*B02C 19/06* (2006.01)

(52) U.S. Cl. ..... 241/5; 241/19

(58) Field of Classification Search ..... 241/5, 39, 241/40, 79.1, 19

See application file for complete search history.

(56) References Cited

U.S. PATENT DOCUMENTS

| | | | |
|---|---|---|---|
| 3,877,647 | A | 4/1975 | Gorobets et al. |
| 4,979,684 | A | 12/1990 | Hoch et al. |
| 5,252,110 | A | 10/1993 | Nied |
| 6,383,706 | B1 | 5/2002 | Kumas et al. |
| 6,398,139 | B1 | 6/2002 | Nied |
| 7,713,614 | B2 | 5/2010 | Chow et al. |
| 2009/0294557 | A1 | 12/2009 | Nied |
| 2010/0065668 | A1 | 3/2010 | Nied |

FOREIGN PATENT DOCUMENTS

| | | |
|---|---|---|
| DE | 3140294 | 4/1983 |
| DE | 3620440 | 12/1987 |
| DE | 3825469 | 2/1990 |
| DE | 19824062 | 12/1999 |
| EP | 0211117 | 7/1977 |
| EP | 021117 | 5/1980 |
| EP | 0472930 | 7/1991 |
| EP | 1080786 | 8/2000 |
| GB | 1481304 | 7/1977 |
| WO | 2007118460 A1 | 10/2007 |

OTHER PUBLICATIONS

Karl Hoffl: Zerkleinerungs—und Klassiermaschinen, Dec. 1986.*

International Search Report for PCT/DE2007/000903 published on Nov. 22, 2007.

(Continued)

*Primary Examiner* — Mark Rosenbaum

(74) *Attorney, Agent, or Firm* — Fleit, Gibbons, Gutman, Bongini & Bianco PL; Paul D. Bianco; Martin Fleit

(57) ABSTRACT

The invention relates to a method for producing very fine particles by means of a jet mill (1). The relative distance $a/d_{Düse}$ between at least approximately concentric milling jet inlets (5) whose center lines intersect at least approximately in one point is adjusted in accordance with the pressure of the working medium, a representing the jet length and $d_{Düse}$ representing the nozzle diameter.

7 Claims, 3 Drawing Sheets

OTHER PUBLICATIONS

International Search Report for PCT/DE2007/000649 published on Oct. 25, 2007.
English translation of International Preliminary Report on Patentability published Nov. 17, 2008 for PCT/DE2007/000649 filed Apr. 13, 2007.
English translation of the Written Opinion published Nov. 14, 2008 for PCT/DE2007/000649 filed Apr. 13, 2007.
English translation of International Preliminary Report on Patentability published May 5, 2009 for PCT/DE2007/000903 filed May 18, 2007.
English translation of the Written Opinion published Apr. 30, 2009 for PCT/DE2007/000903 filed May 18, 2007.
Office Action dated Jan. 12, 2011 for U.S. Appl. No. 12/297,510.
Response filed Jun. 13, 2011 U.S. Appl. No. 12/297,510.

* cited by examiner

METHOD FOR THE PRODUCTION OF VERY FINE PARTICLES BY MEANS OF A JET MILL

FIELD OF THE INVENTION

The present invention relates to a method for producing very fine particles by means of a jet mill.

BACKGROUND OF THE INVENTION

The material to be classified or to be milled consists of coarser and finer particles that are entrained in an air stream and that form the product stream introduced into a housing of an air classifier of the jet mill. The product stream is led in the radial direction into a classifier wheel of the air classifier. In the classifier wheel, the coarser particles are separated from the air stream and the air stream with the fine particles leaves the classifier wheel in the axial direction through an outflow pipe. The air stream with the fine particles to be filtered out or to be produced can then be fed to a filter in which a fluid, such as, for example, air, and fine particles are separated from each other.

From DE 198 24 062 A1, such a jet mill is known, wherein a high-energy milling jet made from superheated steam with a high flow energy is introduced into the milling chamber of the jet mill and the milling chamber has, in addition to the inlet device for the one or more milling jets, an inlet for the milling material and an outlet for the product and wherein, in the region that the milling material intersects at least one milling jet made from superheated steam, the milling jet and milling material have at least approximately the same temperature.

Furthermore, a corresponding air classifier is known, in particular, for a jet mill, e.g., from EP 0 472 930 B1. In principle, this air classifier and its operating method are extremely satisfactory.

From DE 31 40 294 C2, a method and a device are known for separating a mixture of materials into components that can be milled to different degrees. For separating a mixture of materials made from components that can be milled to different degrees into a component that is easier to mill and a component that is harder to mill, the mixture of materials is set into a fluidized state by introducing vapor or gas streams and in this way is subjected to impact crushing. The intensity of the impact crushing is set by the selection of the operating pressure, the velocity, and the direction of the jets in such a way that only the component of the mixture of materials that is easy to mill is crushed. Following the impact crushing, the mixture of materials is exposed to centrifugal force classification. By means of this classification, the component that is easy to mill is separated as fine material and the component that is difficult to mill is separated as coarse material from the non-milled mixture of materials. Here, a fluidized bed jet mill with a centrifugal force classifier above the fluidized bed is used, wherein the mill housing has an annular gap opening into a discharge chamber in the peripheral region of the centrifugal force air classifier. The annular gap is adjustable in its width by means of a concentric ring guided in the mill housing. The axes of the jet nozzles of the fluidized bed jet mill lie in one plane and intersect at one point, and the nozzle openings directed toward each other lie on a circle that is concentric to the mill housing.

DE 38 25 469 A1 discloses a method for the dispersion, crushing, or deagglomeration, and classification of solid materials with a classifying jet mill that combines a jet mill and a spiral stream classifier. The product is supplied by means of the product feeder via injector gas into a dispersing space that is defined by a cover, a milling ring, and a base plate. A milling gas that is simultaneously also a classifying gas is led into a dispersing space via a distribution space and nozzles arranged in the milling ring. This milling gas provides a targeted loading, dwell time, and cut point on the solids according to the admission pressure, amount of gas, and nozzle geometry. The dwell time and cut point can be further varied over wide limits by the feeding of secondary gas that is divided by a cone and that flows through a concentric gap. By feeding the adjustable secondary gas flow via the gap, it is possible to influence the dwell time and loading of the solids in a targeted way. The secondary stream changes the passage likelihood in a collection container and shifts the cut point within the dispersing space toward larger values. Through the concentric gap of variable width, continuous drawing of the portion that is coarse or that is difficult to disperse into the collection container is possible. By varying the milling gas pressure, the milling gas volume stream through the milling ring and various nozzle geometries, as well as the feeding of more or less secondary gas, the crushing and separation results are affected.

Furthermore, EP 1 080 786 A1 of the present inventor discloses a method for fluidized bed jet milling, a device for this method, and a system with this device. Here, for generating a centrifugal force on the fluidized bed in the region of at least one high-energy fluid stream entering into the fluidized bed, the fluidized bed is enclosed by a housing that rotates about an axis that lies at least approximately perpendicular to the one or more fluid streams that are directed essentially opposite the centrifugal force. Therefore, advantageously, the energy exchange between the solid particles that become parts of the high-energy fluid streams can begin already directly after the penetration of the high-energy streams into the fluidized bed and in general, the concentration of the solid particles within the fluid streams is improved.

The present invention has the goal of further optimizing a method for generating very fine particles by means of a jet mill.

SUMMARY OF THE INVENTION

This goal is realized with a method for generating very fine particles according to Claim 1.

Consequently, a method for generating very fine particles by means of a jet mill is characterized in that the relative distance $a/d_{Düse}$ of milling jet inlets 5, that are arranged at least approximately concentrically and whose center lines intersect at least approximately at one point, is set as a function of the operating means pressure, where a stands for the jet length and $d_{Düse}$ stands for the nozzle diameter.

In this way, a method for high-energy, optimized operation of a jet mill by means of compressed gases is advantageously created.

It is preferred that each milling jet inlet be formed by an inlet nozzle or milling nozzle.

Another advantageously provided implementation includes 3 or 4 milling jet inlets.

Advantageously, a fluidized bed jet mill is used.

Furthermore, advantageously, a dynamic air classifier integrated into the jet mill is used. Here, it is further preferably provided that the air classifier contain a classifying rotor or a classifying wheel with an open height increasing with decreasing radius, so that, during operation, the area of the classifying rotor or classifying wheel carrying a flow is at least approximately constant. Alternatively or additionally, it can be provided that the air classifier contain a classifying rotor or a classifying wheel with an immersion pipe that can be, in particular, exchanged and that is shaped so that it rotates at the same time when the classifying rotor or the classifying wheel rotates.

Yet another advantageous implementation of the method provides a fine material discharge chamber that has an increased cross section in the direction of flow.

Preferred and/or advantageous implementations of the invention emerge from the claims and their combinations and also from all of the provided application documents.

BRIEF DESCRIPTION OF THE DRAWINGS

The invention will be explained in more detail using embodiments below with reference to the drawings merely as examples. In these drawings.

DETAILED DESCRIPTION OF THE INVENTION

Figure 1:
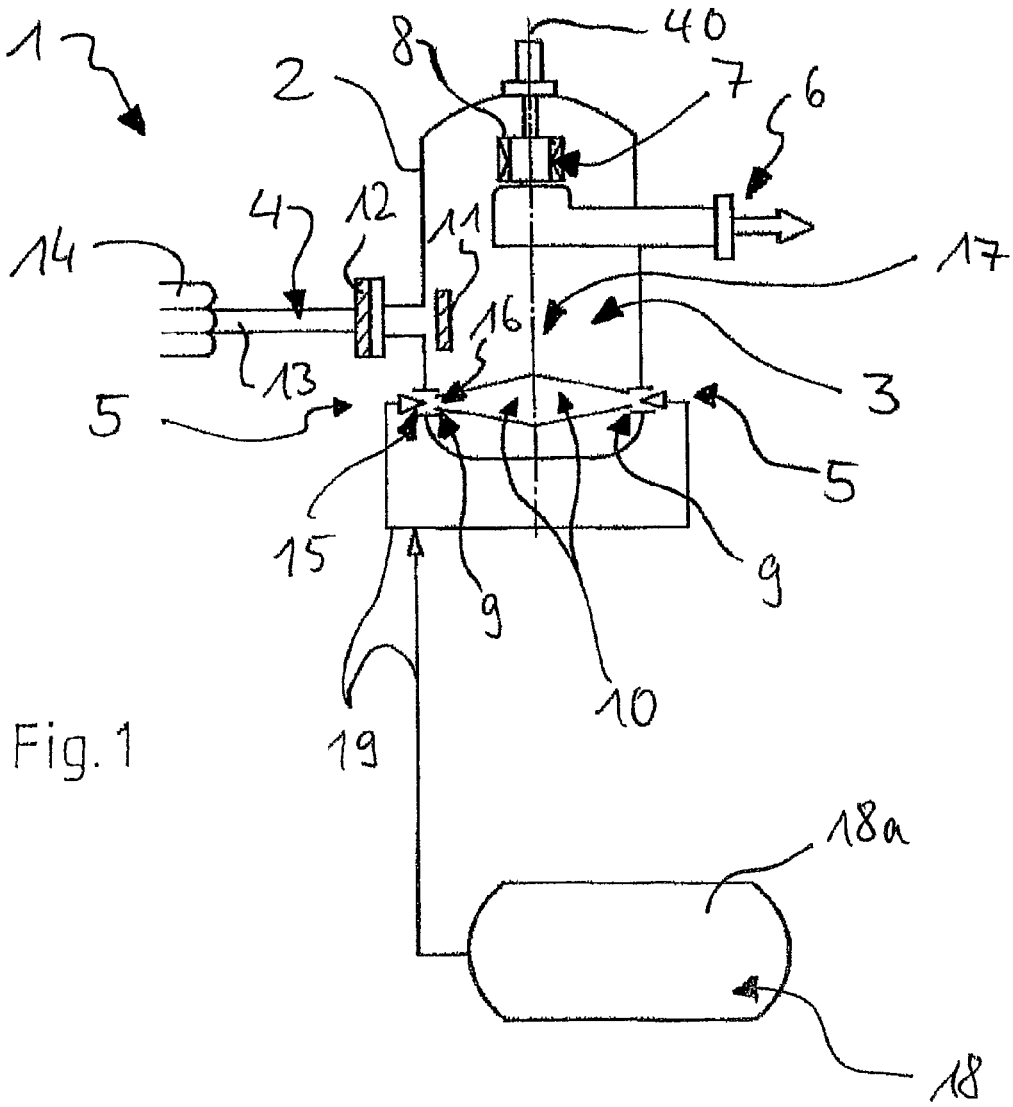
FIG. 1 shows diagrammatically an embodiment of a jet mill in a partially sectioned schematic drawing.

With reference to the embodiments and example applications described below and shown in the drawings, the invention will be explained in more detail merely as examples, i.e., it is not restricted to these embodiments and example applications or to the respective combinations of features within individual embodiments and example applications. Features of the method and device also emerge analogously from device and method descriptions, respectively.

Individual features that are specified and/or shown in connection with actual embodiments are not limited to these embodiments or the combination with the other features of these embodiments, but instead can be combined within the scope of technical possibility with any other variants, even if they are not treated separately in the provided documents.

Identical reference symbols in the individual figures and images of the drawings designate components that are identical or similar or that act identically or similarly. With reference to the illustrations in the drawing, such features also become clear that are not provided with reference symbols independently of whether or not such features are described below. On the other hand, features that are included in the present description but that are not visible or illustrated in the drawing are also easily understood by someone skilled in the art.

For the method for producing very fine particles by means of a jet mill, the new steps provided by the present invention are clear and comprehensible such that a graphic diagram of the individual steps can be eliminated.

In FIG. 1, an embodiment of a jet mill 1 for carrying out the method explained above is shown schematically. As already presented above, the method according to the invention can be performed in a manual or automated way, wherein this choice has no basic effect on the benefit of the method. The automated variant naturally allows further reduction of the operating expenses and can be realized easily with devices and means that are known to someone skilled in the art. However, this does not signify that the individual steps of the method that would be newly created by the present invention would also be known to someone skilled in the art. In any case, a discussion of the sensor, measurement, processor, memory, and control devices and also control in general and in particular appears to be unnecessary, since this implementation according to the device for the method according to the invention requires no separate inventive steps for this knowledge.

The jet mill 1 according to FIG. 1 contains a cylindrical housing 2 that encloses a milling chamber 3, a milling material feeder 4 approximately at half the height of the milling chamber 3, at least one milling jet inlet 5 in the lower region of the milling chamber 3 and a product outlet 6 in the upper region of the milling chamber 3. An air classifier 7 is arranged there with a rotating classifying wheel 8 with which the milling material (not shown) is classified, in order to discharge milling material only below a certain grain size through the product outlet 6 from the milling chamber 3 and to feed milling material with a grain size above the selected value to another milling process.

The classifying wheel 8 can be a classifying wheel that is typical for air classifiers. The blades of these classifiers (see below, e.g., in connection with FIG. 3) define radial blade channels at whose outer ends the classifying air enters and particles of smaller grain size or mass are dragged along to the central outlet and to the product outlet 6, while larger particles or particles of larger mass are deflected under the influence of centrifugal force. In particular, the air classifiers 7 and/or at least its classifying wheel 8 are equipped with at least one configuration feature according to EP 0 472 930 B1.

Solely for the sake of explanation and to facilitate comprehension, milling jet inlets 5, for example, are provided, each made from a radially directed inlet opening or inlet nozzle 9, e.g., that can also be designated as milling nozzles 9, in order to allow a milling jet 10 to meet the milling material particles led from the milling material feeder 4 into the region of the milling jet 10 with high energy and to allow the milling material particles to be crushed into smaller particles that are drawn from the classifying wheel 8 and that are fed outwardly through the product outlet 6 if they have a correspondingly small size or mass. Through the arrangement of the milling jet inlets 5 or, more precisely, correspondingly arranged inlet nozzles or milling nozzles 9 in such a way that the milling jet inlets 5 are arranged at least approximately concentrically and their center lines meet at least approximately at one point, it is achieved that impacting milling jets 10 are formed in such a way that the particle crushing has a more intense effect. In particular, a better effect than is possible with only one milling jet 10 is achieved, in particular, if several milling jets, especially preferably 3 or 4 milling jets, are generated.

In the sense of the invention, in order to create a method for the energetically optimized operation of a jet mill 1, such as, for example, a fluidized bed jet mill, by means of compressed gases, the relative distance $a/d_{Düse}$ of milling jet inlets 5 that are arranged at least approximately concentrically and whose center lines meet at least approximately at one point is set as a function of the operating means pressure, where a stands for the jet length and $d_{Düse}$ stands for the nozzle diameter. It is not absolutely necessary that the preceding condition, i.e., that the milling jet inlets 5 be directed toward each other, particularly in pairs, be also satisfied. Advantageously, instead, 3 or 4 milling jet inlets 5 are provided. It is further preferred that each milling jet inlet 5 be formed by an inlet nozzle or milling jet 9. Furthermore, both manual and also automated activations and controls can be used, wherein suitable detection devices are also provided for detecting the operating means pressure and the relative distance of each milling jet inlet 5.

Such devices for detecting, determining, and comparing values and also for corresponding control and displacement of the milling jet inlets 5 for setting their relative distances are known to someone skilled in the art, who can easily select and use them using the knowledge of the present invention, without having to perform inventive activity himself. A more detailed discussion of such devices for detecting, determining, and comparing values and also for corresponding control and displacement of the milling jet inlets 5, in particular, for setting their relative distances, is therefore unnecessary.

Furthermore, for example, the processing temperature can be influenced through the use of an internal heat source 11 between the milling material feeder 4 and the region of the milling jets 10 or a corresponding heat source 12 in the region outside of the milling material feeder 4 or by processing particles of an otherwise already hot milling material that is led into the milling material feeder 4 while avoiding heat losses, wherein a supply pipe 13 is surrounded by a temperature-insulating sleeve 14. The heat source 11 or 12 can be selected arbitrarily according to requirements and therefore can be used according to the purpose and can be selected according to availability on the market, so that additional explanations are not required.

For the temperature, in particular, the temperature of the milling jet or the milling jets 10 is relevant, and the temperature of the milling material should correspond at least approximately to this milling jet temperature.

For forming the milling jets 10 introduced into the milling chamber 3 through milling jet inlets 5, for example, superheated steam can be used, but also any other suitable fluid. For the use of superheated steam it is assumed that the heat content of the water steam after the inlet nozzle 9 of each milling jet inlet 5 is not essentially less than before this inlet nozzle 9. Because the energy required for the impact crushing is primarily provided as flow energy, accordingly, the pressure drop between the inlet 15 of the inlet nozzle 9 and its outlet 16 can be significant (the pressure energy is converted to a large extent into flow energy) and the temperature drop can also be significant. In particular, this temperature drop should be sufficiently compensated by the heating of the milling material such that the milling material and milling jet 10 have the same temperature in the region of the center 17 of the milling chamber 3 for at least two intersecting milling jets 10 or a multiple of two milling jets 10.

For configuring and carrying out the preparation of the milling jet 10 from superheated steam, in particular, in the form of a closed system, refer to DE 198 24 062 A1, whose complete disclosure contents in this respect are incorporated herein in their full extent for avoiding a purely identical transfer by the present reference. Through a closed system, for example, milling of hot slag as milling material is possible with optimal efficiency.

In the illustration of the present embodiment of the jet mill 1, as a representative for each supply of operating means or an operating medium B, a reservoir or generating device 18, for example, a tank 18*a* is shown, from which the operating means or operating medium B is led via channel devices 19 to the milling jet inlet 5 or the milling jet inlets 5 for forming the milling jet 10 or the milling jets 10. Instead of the tank 18*a*, e.g., a compressor can also be used to provide a corresponding operating medium B.

In particular, starting with a jet mill 1 equipped with such an air classifier 7, a method is performed for producing very fine particles with this jet mill 1 with an integrated dynamic air classifier 7, wherein the embodiments in this respect are intended and are to be understood herein only as examples and not as restrictive. As the operating means B, in general, a fluid is used, preferably the already mentioned steam, but also hydrogen gas or helium gas or simple air.

Furthermore, it is advantageous and therefore preferred if the classifying rotor 8 has an open height that increases with decreasing radius, that is, toward its axis, wherein, in particular, the area of the classifying rotor 8 carrying a flow is constant. Additionally or alternatively, a fine material discharge chamber (not shown) can be provided that has an expanded cross section in the direction of flow.

An especially preferred implementation for the jet mill 1 consists of classifying rotor 8 having an exchangeable, co-rotating immersion pipe 20.

Solely for the sake of explanation and to enhance overall comprehension, further details regarding the particles to be generated from the material to be processed will be discussed below. For example, this material involves amorphous $SiO_2$ or other amorphous chemical products that are crushed with the jet mill. Other materials are silicic acids, silica gels, or silicates or materials based on or containing carbon black.

Below, with reference to FIGS. 2 and 3, additional details and variants of example implementations of the jet mill 1 and their components will be explained.

Figure 2:
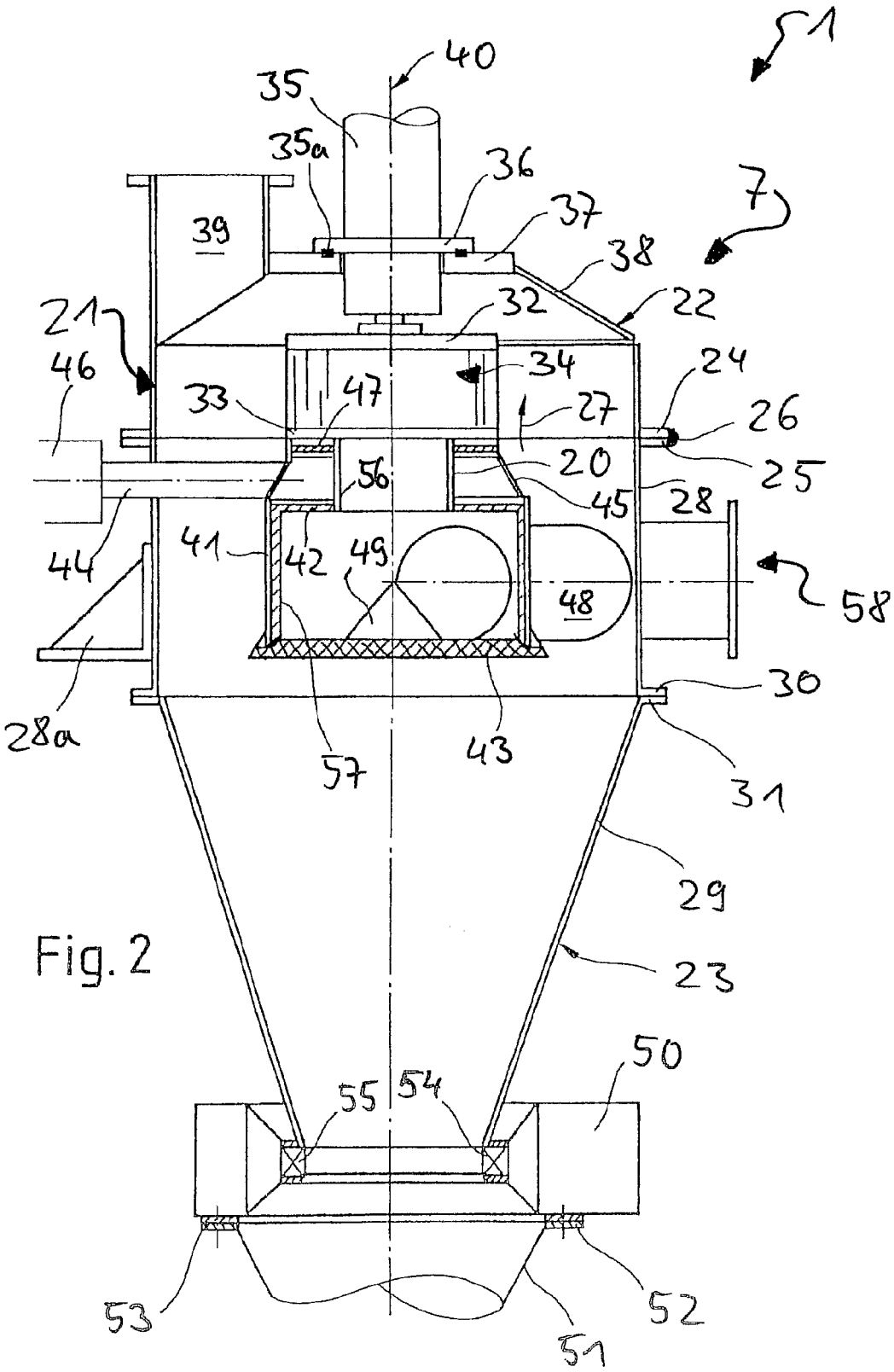
FIG. 2 shows an embodiment of an air classifier of a jet mill in a vertical arrangement and as a schematic center longitudinal section, wherein the outlet pipe for the mixture made of the classifying air and solid particles is allocated to the classifying wheel.

As to be taken from the schematic diagram in FIG. 2, the jet mill 1 contains an integrated air classifier 7. In implementations of the jet mill 1 as a fluidized bed jet mill, this air classifier involves a dynamic air classifier 7 that is advantageously arranged in the center of the milling chamber 3 of the jet mill 1. The desired fineness of the milling material can be influenced as a function of the milling gas volume flow and the classifier rotational speed.

In the air classifier 7 of the jet mill 1 according to FIG. 2, the entire vertical air classifier 7 is enclosed by a classifier housing 21 that is made essentially from the upper part 22 of the housing and the lower part 23 of the housing. The upper part 22 of the housing and the lower part 23 of the housing are provided on the upper and lower edges with outward directed peripheral flanges 24 and 25, respectively. In the installed or functional state of the air classifier 8, the two peripheral flanges 24, 25 lie one on the other and are fixed relative to each other by suitable means. Suitable means for fixing are, for example, screw connections (not shown). Clamps (not shown) or the like can also be used as detachable attachment means.

At a practically arbitrary position of the flange periphery, both peripheral flanges 24 and 25 are connected to each other by a hinge 26 so that the upper part 22 of the housing can be pivoted upward in the direction of the arrow 27 relative to the lower part 23 of the housing after detachment of the flange connection means so that the upper part 22 of the housing is accessible from below and the lower part 23 of the housing is accessible from above. The lower part 23 of the housing is formed, for its part, in two pieces, and is made essentially from the cylindrical classifying space housing 28 with the peripheral flange 25 on its upper open end and a discharge cone 29 that tapers conically downward. The discharge cone 29 and the classifying space housing 28 lie one on the other on the upper or lower end with flanges 30, 31, and the two flanges 30, 31 of the discharge cone 29 and classifying space housing 28 are connected to each other like the peripheral flange 24, 25 by detachable attachment means (not shown). The classifier housing 21 assembled in this way is suspended in or on support arms 28*a*. Several of these support arms are spaced apart as uniformly as possible about the periphery of the classifier or compressor housing 21 of the air classifier 7 of the jet mill 1 and contact the cylindrical classifying space housing 28.

An essential part of the installed housing equipment of the air classifier 7 is, in turn, the classifying wheel 8 with an upper cover 32, with an axially spaced lower outflow-side cover 33, and with blades 34 with preferred contours arranged between the outer edges of the two covers 32 and 33 and rigidly connected to these covers and distributed uniformly about the periphery of the classifying wheel 8. In this air classifier 7, the classifying wheel 8 is driven by means of the upper cover 32, while the lower cover 33 is the outflow-side cover. The support of the classifying wheel 8 comprises a preferably forcibly driven classifying wheel shaft 35 that is led out of the classifier housing 21 with the upper end and supports the classifying wheel 8 locked in rotation with its lower end within the classifier housing 21 in a floating bearing. Leading the classifying wheel shaft 35 out of the classifier housing 21 is realized in a pair of processed plates 36, 37 that close the classifier housing 21 on the upper end of an upward frustum-shaped housing end section 38 and that guide the classifying wheel shaft 35 and that seal this shaft passage without preventing the rotational movements of the classifying wheel shaft 35. Preferably, the upper plate 36 can be allocated as a flange without rotational play on the classifying wheel shaft 35 and can be rotatably supported by means of a rotational bearing 35*a* on the lower plate 37 that is allocated, on its side, to a housing end section 38. The lower side of the outflow-side cover 33 lies in the common plane between the peripheral flanges 24 and 25, so that the classifying wheel 8 is arranged in its entirety within the folding upper part 22 of the housing. In the region of the conical housing end section 38, the upper part 22 of the housing also has a pipe-like product feeder port 39 of the milling material feeder 4 whose longitudinal axis runs parallel to the rotational axis 40 of the classifying wheel 8 and its drive or classifying wheel shaft 35 and that is as far as possible from this rotational axis 40 of the classifying wheel 8 and its drive or classifying wheel shaft 35 arranged radially outward on the upper part 22 of the housing.

The classifier housing 21 receives the tubular discharge port 20 that is arranged coaxially to the classifying wheel 8 and that lies with its upper end tight underneath the outflow-side cover 33 of the classifying wheel 8, but without being connected to said classifying wheel. There is a discharge chamber 41 that is similarly tubular but whose diameter is significantly larger than the diameter of the discharge port 20 and is, in the present embodiment, at least twice as large as the diameter of the discharge port 20. This discharge chamber is placed coaxially to the lower end of the discharge port 20 constructed as a pipe. Thus, there is a clear jump in diameter at the transition between the discharge port 20 and the discharge chamber 41. The discharge port 20 is inserted into an upper cover plate 42 of the discharge chamber 41. At the bottom, the discharge chamber 41 is closed by a removable cover 43. The structural unit made from the discharge port 20 and the discharge chamber 41 is held in several support arms 44 that are distributed like a star uniformly about the periphery of the structural unit, with their inner ends in the region of the discharge port 20 being rigidly connected to the structural unit and being fixed with their outer ends on the classifier housing 21.

The discharge port 20 is surrounded by a conical ring housing 45 whose lower, larger outer diameter corresponds at least approximately to the diameter of the discharge chamber 41, and whose upper, smaller outer diameter corresponds at least approximately to the diameter of the classifying wheel 8. The support arms 44 end at the conical wall of the ring housing 45 and are rigidly connected to this wall and are part of the structural unit made from the discharge port 20 and discharge chamber 41.

The support arms 44 and the ring housing 45 are parts of a flushing air device (not shown), wherein the flushing air prevents the penetration of material out of the interior space of the classifier housing 21 into the gap between the classifying wheel 8 or, more precisely, its lower cover 3 and the discharge port 20. To allow this flushing air to reach into the ring housing 45 and from there into the gap to be kept open, the support arms 44 are constructed as pipes, with their outer end sections passed through the wall of the classifier housing 21 and connected via a suction filter 46 to a flushing air source (not shown). The ring housing 45 is closed from above by a perforated plate 47 and the gap itself can be adjusted by an axially adjustable ring disk in the region between the perforated plate 47 and the lower cover 33 of the classifying wheel 8.

The outlet from the discharge chamber 41 is formed by a fine material discharge pipe 48 that is guided outward into the classifier housing 21 and is connected to the discharge chamber 41 in the tangential arrangement. The fine material discharge pipe 48 is a component of the product outlet 6. A deflector cone 49 is used as the lining of the opening of the fine material discharge pipe 48 to the discharge chamber 41.

On the lower end of the conical housing end section 38, a classifying air inlet spiral 50 and a coarse material discharge 51 are allocated to the housing end section 38 in the horizontal arrangement. The rotational direction of the classifying air inlet spiral 50 is directed opposite the rotational direction of the classifying wheel 8. The coarse material discharge 51 is allocated to the housing end section 38 in a removable way, wherein a flange 52 is allocated to the lower end of the housing end section 38 and a flange 53 is allocated to the upper end of the coarse material discharge 51, and both flanges 52 and 53 are in turn detachably connected to each other by known means when the air classifier 7 is ready to operate.

The dispersion zone to be established is designated by 54. Flanges worked (beveled) on the inner edge for a clean flow guidance and simple lining are designated by 55.

Finally, an exchangeable protective tube 56 as a closing part is also applied to the inner wall of the discharge port 20, and a corresponding, exchangeable protective tube 57 can be applied to the inner wall of the discharge chamber 41.

At the beginning of the operation of the air classifier 7 in the shown operating state, classifying air is introduced into the air classifier 7 with a pressure drop and with an inlet velocity selected according to requirements via the classifying air inlet spiral 50. Due to the introduction of the classifying air by means of a spiral, particularly in connection with the tapering of the housing end section 38, the classifying air increases upwardly like a spiral into the region of the classifying wheel 8. At the same time, the "product" made from solid particles of varying mass is input into the classifier housing 21 via the product feeder port 39. Of this product, the coarse material, i.e., the portion of particles with greater mass, moves against the classifying air into the region of the coarse material discharge 51 and is provided for further processing. The fine material, i.e., the portion of particles with lower mass, is mixed with the classifying air, is moved radially from the outside to the inside by the classifying wheel 8 into the discharge port 20, into the discharge chamber 41, and finally, via a fine material discharge pipe 48, into a fine material discharge or outlet 58, and also from there into a filter in which the operating means in the form of a fluid, such as air, for example, and fine material are separated from each other. Coarser fine material components are centrifuged radially out of the classifying wheel 8 and mixed with the coarse material, in order to leave the classifier housing 21 with the coarse material or to circulate in the classifier housing 21 until it has become fine material of such a grain size that it is discharged with the classifying air.

Due to the abrupt expansion in cross section from the discharge port 20 to the discharge chamber 41, a clear reduction in the flow velocity of the fine material-air mixture takes place there. This mixture is thus led with very low flow velocity through the discharge chamber 41 via the fine material discharge pipe 48 into the fine material outlet 58, and the wall of the discharge chamber 41 is worn only to a small extent. In contrast, the protective tube 57 is also only an extreme, precautionary measure. The high flow velocity in the classifying wheel 8 due to good separating technology is still created, however, in the discharge or outlet port 20, which is why the protective tube 56 is more important than the protective tube 57. Especially significant is the jump in diameter with a diameter expansion at the transition from the discharge port 20 into the discharge chamber 41.

Incidentally, the air classifier 7 can be easily serviced through the subdivision of the classifier housing 21 in the described way and the allocation of the classifier components to the individual subhousings, and damaged components can be replaced at relatively little expense and within short maintenance times.

Figure 3:
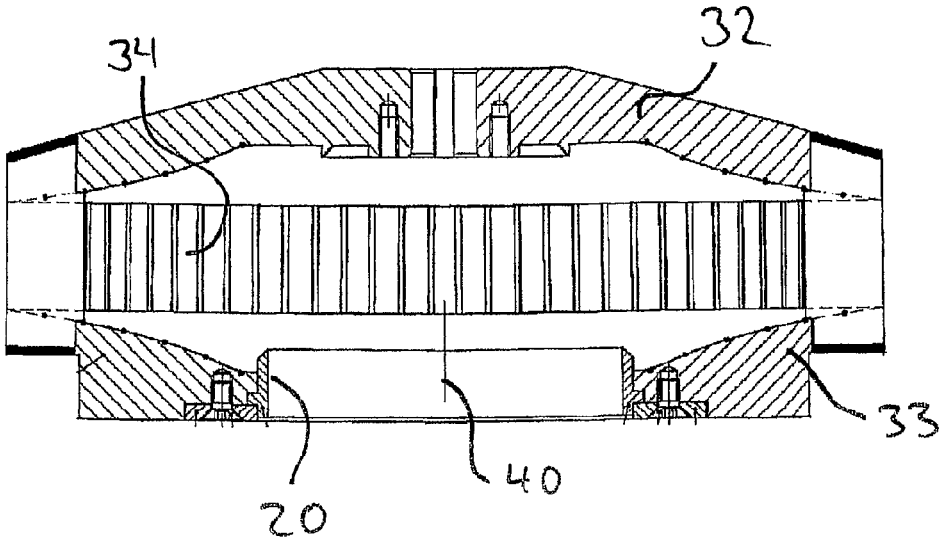
FIG. 3 shows in a schematic diagram and as a vertical section a classifying wheel of an air classifier.

While the schematic illustration of FIG. 2 shows the classifying wheel 8 with the two covers 32 and 33 and with the blade collar 59 arranged between these covers with the blades 34 still in the already known, typical form with parallel and parallel-surface covers 32 and 33, FIG. 3 shows the classifying wheel 8 for another embodiment of the air classifier 7 of an advantageous improvement.

This classifying wheel 8 according to FIG. 3 also contains, in addition to the blade collar 59 with the blades 34, the upper cover 32 and the axially spaced, lower, outflow-side cover 33, and can rotate about the rotational axis 40 and thus the longitudinal axis of the air classifier 7. The diametric expansion of the classifying wheel 8 is perpendicular to the rotational axis 40, i.e., to the longitudinal axis of the air classifier 7, independently of whether the rotational axis 40 and thus the mentioned longitudinal axis is vertical or horizontal. The lower outflow-side cover 33 concentrically encloses the discharge port 20. The blades 34 are connected to both covers 33 and 32. The two covers 32 and 33 are now formed conically differing from the state of the art, preferably such that the distance from the upper cover 32 to the outflow-side cover 33 becomes greater from the collar 59 of the blades 34 inwardly, i.e., toward the rotational axis 40, that is, preferably continuously, for example, in a linear or nonlinear way, and with a large advantage so that the area of the cylinder sleeve carrying a flow remains constant for each radius between the blade discharge edges and discharge ports 20. The outflow velocity that becomes smaller due to the radius that becomes smaller in known solutions remains constant in this solution.

In addition to the variant explained above and in FIG. 3 for the configuration of the upper cover 32 and the lower cover 33, it is also possible that only one of these two covers 32 or 33 has a conical construction as explained, and that the other cover 33 or 32 is flat, as is the case in connection with the embodiment according to FIG. 2 for both covers 32 and 33. In particular, here the shape of the non-parallel surface cover can be such that the area of the cylinder sleeve carrying a flow remains at least approximately constant for each radius between the blade discharge edges and discharge ports 20.

Below, for further explanation and as a basis for further inventive aspects, the optimal jet length for jet mills will be discussed.

From observations of test results in the low-pressure range ($p_0$<4 bar (abs)), a dependence of the optimal jet length on the milling gas pressure can be deduced. An approach will be shown below for quantifying this dependence. At the same time, a theoretical prediction is performed regarding whether there is also such a dependence on the milling gas temperature.

To describe the processes during the jet expansion, it is initially assumed that both the pressure relationships regarding the jet envelope through which the solid particles to be crushed are led into the jet in order to be accelerated and crushed there and also regarding the "backup surface" where two or more jets possibly meet should be constant.

It is further assumed that these pressure relationships correlate with the pulse flow density in the jet:

$$I^* = \frac{m_L * v_{ad}}{A_{Strahl}} = C_1 \tag{1}$$

where $A_{Strahl}$ [m$^2$] the surface area of the jet
$C_1$ constant
$I^*$ [N/m$^2$] pulse flow density
$m_L$ [kg/s] gas mass flow
$v_{ad}$ [m/s] adiabatic gas velocity after the nozzle.

(Can be calculated with the mass flow and the velocity at the nozzle outlet because the pulse flow in the jet is maintained.)

Under the prerequisite that the jet propagates conically and the jet opening angle $\alpha$ is independent of pressure and temperature (at the least, the first was determined in studies by Joachim Hägele: Experimental studies on aerosol jets from micro-nozzles; Reports from the Max-Planck-Institut für Strömungsforschung [Max Planck Institute for Fluid Dynamics], No. 72, 1981, for constantly tapering nozzles just like for de Laval nozzles adapted to the pressure relationship), both surfaces can be calculated according to the geometric relationship $$A_{Strahl}=C_2\cdot\pi\cdot a^2 \tag{2}$$

with $$C_2=f(a) \tag{3}$$

where, furthermore, $C_2$ constant
a [m] jet length.

The gas mass flow through a nozzle gives $$m_L = \frac{d_{Düse}^2\cdot\pi}{4}\cdot p_0\cdot\psi_{max}\cdot\sqrt{\frac{2}{R\cdot T_0}}, \tag{4}$$

the adiabatic jet discharge velocity becomes $$v_{ad} = \sqrt{2\cdot\frac{\kappa}{\kappa-1}\cdot R\cdot T_0\cdot\left[1-\left(\frac{p_1}{p_0}\right)^{\frac{\kappa-1}{\kappa}}\right]} \tag{5}$$

where, in addition, $d_{Düse}$ [m] nozzle diameter
$m_L$ [kg/s] gas mass flow
$p_1$ [bar (abs)] expansion pressure
$p_0$ [bar (abs)] gas pressure before the nozzle
R [kJ/kgK] gas constant
$T_0$ [K] gas temperature before the nozzle
$\kappa$ isoentropic exponent
$\psi_{max}$ outflow coefficient If the equations 2, 4, and 5 are inserted into equation 1, then one obtains $$I^* = C_1 = \sqrt{C_3^2 \cdot p_0 \cdot \psi_{max}^2 \cdot \frac{\kappa}{\kappa - 1} \cdot \left[1 - \left(\frac{p_1}{p_0}\right)^{\frac{\kappa-1}{\kappa}}\right]} \quad (6)$$

with $$C_3 = \frac{1}{2 \cdot C_2} \quad (7)$$

and $$\psi_{max} = \sqrt{\frac{\kappa}{\kappa + 1}} \cdot \left(\frac{2}{\kappa + 1}\right)^{\frac{1}{\kappa-1}} \quad (8)$$

where, in addition, $C_3$ is a constant.

Finally, if one sets $$C = \sqrt{\frac{C_2}{C_3}} \quad (9)$$

where

C is a constant then after rearranging, one obtains $$\frac{a}{d_{Düse}} = a_{rel} = C \cdot \sqrt[4]{p_0^2 \cdot \psi_{max}^2 \cdot \frac{\kappa}{\kappa - 1} \cdot \left[1 - \left(\frac{p_1}{p_0}\right)^{\frac{\kappa-1}{\kappa}}\right]} \quad (10)$$

where, finally $a_{rel}$ relative jet length.

Consequently, the jet length $a_{rel}$ is only dependent on the milling gas pressure $p_0$, the pressure ratio $p_1/p_0$, and K, but not on the milling gas temperature.

From tests (see also R. Nied: Jet milling in fluidized bed counter jet mill; tiz 109 (1985)1, pp. 23ff) it is known that for a milling gas pressure of p0=7 bar (abs)

a pressure ratio of and [sic]

κ=1.4 the relative jet length $a_{rel}$=20.

Thus the value of the constants C can be calculated to be $$C=9.922 \quad (11).$$

Figure 4:
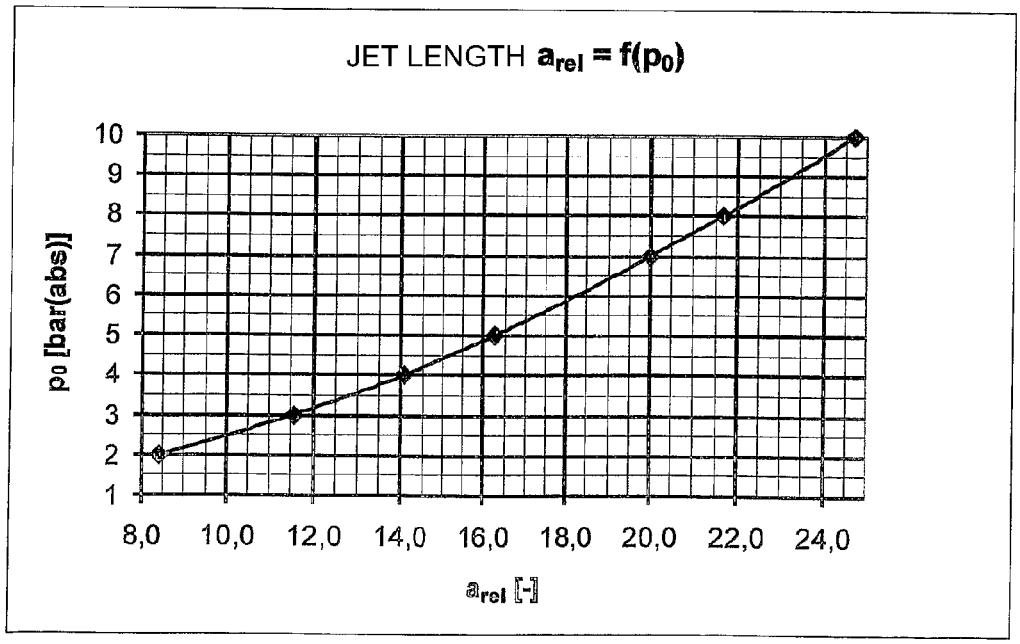
FIG. 4 shows a graphic diagram of the relation between the gas pressure $p_0$ before the nozzle and the relative jet length $a_{rel}$.

In FIG. 4, the relation between the gas pressure $p_0$ before the nozzle and the relative jet length $a_{rel}$ is shown graphically on the basis of the graphic evaluation of equation 10 with C according to equation 11.

The invention is described merely in terms of examples with reference to embodiments in the description and in the drawing and is not limited to these embodiments, but instead includes all variations, modifications, substitutions, and combinations that someone skilled in the art takes from the present documents, in particular, in the scope of the claims and the general descriptions in the introduction of this description and also the description of the embodiments and their representations in the drawing, and can combine with his technical knowledge and also with the state of the art. In particular, all of the individual features and possible implementations of the invention and their variants can be combined.

LIST OF REFERENCE SYMBOLS

1 Jet mill
2 Cylindrical housing
3 Milling chamber
4 Milling material feeder
5 Milling jet inlet
6 Product outlet
7 Air classifier
8 Classifying wheel
9 Inlet opening or inlet nozzle or milling nozzle
10 Milling jet
11 Heat source
12 Heat source
13 Supply pipe
14 Temperature-insulating sleeve
15 Inlet
16 Outlet
17 Center of milling chamber
18 Reservoir or generating device
19 Channel devices
20 Discharge port
21 Classifier housing
22 Upper part of housing
23 Lower part of housing
24 Peripheral flange
25 Peripheral flange
26 Hinge
27 Arrow
28 Classifying space housing
**28*a*** Support arms
29 Discharge cone
30 Flange
31 Flange
32 Cover
33 Cover
34 Blade
35 Classifying wheel shaft
**35*a*** Rotating bearing
36 Upper processed plates
37 Lower processed plate
38 Housing end section
39 Product feeder port
40 Rotational axis
41 Discharge chamber
42 Upper cover plate
43 Removable cover
44 Support arms
45 Conical ring housing
46 Suction filter
47 Perforated plate
48 Fine material discharge pipe
49 Deflection cone
50 Classifying air inlet spiral
51 Coarse material discharge
52 Flange
53 Flange
54 Dispersion zone
55 Flange processed (beveled) at the inner edge and lining
56 Exchangeable protective pipe
57 Exchangeable protective pipe
58 Fine material discharge/outlet
59 Blade collar

The invention claimed is:

1. A method for producing very fine particles by means of a jet mill, comprising:

arranging a plurality of jet inlets, each including an inlet nozzle, approximately concentrically about the jet mill with respect to each other, so that a central axis through the jet inlets converge to approximately one point;

determining a relative distance $a/d_{Düse}$ of milling jet inlets as a function of the operating means pressure, where a stands for the jet length and $d_{Düse}$ stands for the nozzle diameter.

2. The method of claim 1, wherein said plurality of milling jet inlets includes 3 or 4 milling jet inlets.

3. The method of claim 1, wherein said jet mill is a fluidized bed jet mill.

4. The method of claim 1, wherein a dynamic air classifier is integrated into the jet mill.

5. The method of claim 4, wherein the air classifier contains a classifying rotor or a classifying wheel with an open height increasing with decreasing radius, so that during operation, the area of the classifying rotor or wheel carrying a flow is at least approximately constant.

6. The method of claim 4, wherein the air classifier contains a classifying rotor or a classifying wheel with an exchangeable immersion pipe constructed in such a way that it rotates at the same time that the classifying rotor or the classifying wheel rotates.

7. The method of claim 1, wherein a fine material discharge chamber is provided that has an expanded cross section in the direction of flow.

* * * * *